US009058020B2

(12) United States Patent
Rochat

(10) Patent No.: US 9,058,020 B2
(45) Date of Patent: Jun. 16, 2015

(54) MECHANISM FOR ADVANCING A KARUSSEL CAGE BY PERIODIC JUMPS

(75) Inventor: Marco Rochat, Le Brassus (CH)

(73) Assignee: Blancpain SA, Le Brassus (CH)

( * ) Notice: Subject to any disclaimer, the term of this patent is extended or adjusted under 35 U.S.C. 154(b) by 162 days.

(21) Appl. No.: 13/702,192

(22) PCT Filed: Jun. 7, 2011

(86) PCT No.: PCT/EP2011/059349

§ 371 (c)(1), (2), (4) Date: Feb. 28, 2013

(87) PCT Pub. No.: WO2011/157591

PCT Pub. Date: Dec. 22, 2011

(65) Prior Publication Data

US 2013/0155820 A1 Jun. 20, 2013

(30) Foreign Application Priority Data

Jun. 17, 2010 (EP) ..... 10166367

(51) Int. Cl.

| | |
|---|---|
| ***G04B 15/00*** | (2006.01) |
| ***G04C 5/00*** | (2006.01) |
| ***G04B 15/12*** | (2006.01) |
| ***G04B 17/28*** | (2006.01) |

(52) U.S. Cl.

CPC ..... *G04B 15/12* (2013.01); *G04B 17/28* (2013.01); *G04B 17/285* (2013.01)

(58) Field of Classification Search

CPC ..... G04B 17/00; G04B 17/285; G04B 15/00

USPC ..... 368/127, 129–133

See application file for complete search history.

(56) References Cited

U.S. PATENT DOCUMENTS

| | | | | |
|---|---|---|---|---|
| 2001/0023385 | A1* | 9/2001 | Nishimura et al. | 701/51 |
| 2003/0112709 | A1* | 6/2003 | Mojon | 368/127 |
| 2005/0088918 | A1 | 4/2005 | Journe | |
| 2005/0217169 | A1* | 10/2005 | Kunz | 47/33 |
| 2007/0127319 | A1* | 6/2007 | Goeller | 368/124 |
| 2007/0237035 | A1* | 10/2007 | Helfer et al. | 368/147 |
| 2011/0096635 | A1* | 4/2011 | Calabrese | 368/127 |
| 2013/0194900 | A1* | 8/2013 | Capt | 368/129 |

FOREIGN PATENT DOCUMENTS

| | | |
|---|---|---|
| CH | 47297 | 6/1910 |
| EP | 1 528 443 | 5/2005 |
| EP | 1 772 783 | 4/2007 |

OTHER PUBLICATIONS

International Search Report Issued Sep. 29, 2011 in PCT/EP11/59349 Filed Jun. 7, 2011.

* cited by examiner

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A mechanism for advancing, by periodic jumps, a cage of an escapement mechanism, including: a pivoting retaining mechanism authorizing or preventing pivoting of the cage, depending on whether the retaining mechanism is moving or not; and a stopping mechanism cooperating with the retaining mechanism to allow or prevent the pivoting of the retaining mechanism according to the position of the stopping mechanism. The trajectory of the retaining mechanism interferes with that of the stopping mechanism, both being external to the cage, and the retaining mechanism includes a flirt pinion carrying a flirt arranged to cooperate with the stopping mechanism and whose trajectory interferes with the stopping mechanism, the flirt pinion cooperating with a toothing of the cage, via an inverter wheel set.

17 Claims, 2 Drawing Sheets

MECHANISM FOR ADVANCING A KARUSSEL CAGE BY PERIODIC JUMPS

CROSS-REFERENCE TO PRIORITY APPLICATIONS

This is a National Phase Application in the United States of International Patent Application PCT/EP2011/059349 filed Jun. 7, 2011, which claims priority on European Patent Application No. 10166367 2 of Jun. 17, 2010. The entire disclosures of the above patent applications are hereby incorporated by reference.

FIELD OF THE INVENTION

The invention concerns a mechanism for advancing, by periodic jumps, a cage pivoting about a cage axis, said cage carrying an escape wheel and an escape pinion in addition to a pallet lever cooperating with said escape wheel and with a sprung balance, said mechanism comprising:

- a motion transmitting gear train driven by an input drive means to pivot said cage and said escape pinion;
- a pivoting retaining means arranged to cooperate with said cage to authorise or to prevent the pivoting of said cage, depending on whether said retaining means is pivoting or stopped;
- a pivoting stopping means arranged to cooperate with said retaining means to authorise or prevent the pivoting of said retaining means, according to the angular pivoting position of said pivoting stopping means;
- said retaining means having a trajectory that intersects that of said stopping means.

The invention more particularly concerns a jump mechanism for the cage of an independent seconds karussel.

The invention also concerns a karussel including a karussel cage and mechanism of this type.

The invention concerns the field of horology.

It more particularly concerns the field of watches with complications.

BACKGROUND OF THE INVENTION

The jumping display, known as an independent seconds or independent minutes display, or any other time interval, is always a complex complication to make, since known embodiments cause a relatively abrupt jump, which results in shocks inside the mechanism, which are transmitted as far as the escapement, which is not ideal for the proper working and longevity of the watch.

These known embodiments generally combine a mechanism using cooperation between a star wheel and a flirt on the one hand, and a constant force device on the other hand, to moderate the effects of any shock on the movement.

Thus Swiss Patent No. CH 47 297 in the name of Pellaton-Schild disclosed, in 1907, a independent jumping seconds mechanism, with two contrate gears connected to each other by a spiral spring, one of which drives the escape pinion, which is coaxial and secured to a star wheel comprising projecting teeth. Via a gear train, the going barrel drives a pinion carrying a flirt, which rests each time on one tooth of the star wheel, and the relative pivoting thereof causes a position in which the flirt escapes from the tooth, in a jump, and completes one revolution before returning to abut on another tooth of the star wheel.

There is known a European Patent Application No. 1 319 997 in the name of Richemont International SA which discloses a tourbillon mechanism incorporating a constant force device.

This tourbillon mechanism includes a pivoting cage driven by a drive wheel. The tourbillon cage is coaxial to a pivoting balance provided with a balance spring and with a fixed fourth wheel and carries, at three distinct off-centre positions, an off-centre escape wheel, a first pallet lever and a stop wheel which meshes with said fixed fourth wheel. The escape wheel cooperates with said first pallet lever provided with two pallet stones. Coaxial to the escape wheel, a constant force device includes an escape spring, secured at a first end to the escape wheel, and at a second end to a force compensating disc. The disc rotates integrally with a ring for winding the escape spring and with a winding ring pinion associated therewith which cooperates with the fixed fourth wheel.

Coaxially secured to the escape wheel, a substantially triangular Reuleux cam cooperates with a fork comprised in a second pallet lever coaxial to the balance, which pivots about the axis of the tourbillon cage. This second pallet lever comprises a cam arranged to cooperate with a fork and a dart carried by the first pallet lever. The second pallet lever includes two pallet stones arranged to cooperate with radially projecting teeth comprised in the stop wheel.

The balance is driven under the effect of the prestress of the escape wheel and is returned by the balance spring. Depending on the number of teeth of the escape wheel, the balance makes a certain number of vibrations, for example five with a wheel having fifteen teeth, before the stop wheel and tourbillon cage are released by the Reuleux cam and the second pallet lever is centred on the balance. Depending upon the number of teeth it has, the stop wheel achieves a given angular travel, for example 90°, before being stopped again by one of the pallet stones of the second pallet lever centred on the balance. Since the stop wheel and the stop pinion are carried by the tourbillon cage and since the stop pinion meshes with the fixed fourth wheel, the pivoting of the stop wheel causes the tourbillon cage to pivot. Consequently, this pivoting also causes the winding ring, which is fixed to the cage and also meshes with the fourth wheel, to pivot, tensioning the escape spring again, since the escape wheel is then locked by the first pallet lever. The escape spring is periodically tensioned again by the repetition of this cycle. The spring thus accumulates enough energy to deliver sufficient torque to maintain the oscillations of the balance.

The object of this compensation mechanism is to deliver a constant torque.

The first end of the escape spring is secured to a first pin integral with a first escape spring collet connected to the escape wheel. The second end of the escape spring is fixed to a second pin secured to a second mobile escape spring collet.

The escape spring, once taut, exerts a force on the first pin, and therefore exerts a torque on a first arm of the force compensating disc comprised in said constant force device. The latter includes first and second arms, arranged to abut respectively on the first and second pin, and the bearing surfaces of these arms are aligned with each other but in an off-centre direction relative to the axis of the escape wheel. The second arm abuts on the second pin and transmits the torque to the fixed spring collet and to the escape wheel. Due to the off-centre arrangement of the direction of the two arms, the lever arm of the stresses exerted by and on the pins varies according to the angular position of the force compensating disc, despite the lost tension of the escape spring while the gear train assembly is stopped from the spring to the stop wheel.

During each vibration of the balance, the escape wheel is released from the first pallet lever and pivots through a certain angle, under the action of the escape spring, just like the first spring collet and the force compensating disc, whereas the winding ring and stop wheel are locked. On each fifth vibration, the stop wheel and the tourbillon cage are released.

This EP Patent No. 1 319 997 therefore discloses a perfectly functional system, which provides a seconds display in a tourbillon cage, but which remains very complex, and requires a constant force device further complicated by a compensating mechanism. It has to comprise two springs, two pallet levers, a cam fork device and not only has a high production cost due to the number and complexity of the components, but is relatively fragile and difficult to adjust properly.

EP Patent Application No. 1 772 783 in the name of MONTRES BREGUET SA discloses a watch movement including a constant force device, and an independent minute display on the centre wheel, which is capable of driving a tourbillon in a satisfactory manner with the constant force device. It includes a third wheel set, which completes one revolution in several minutes, and which forms the input device of a constant force device. The output element of this balance spring device is formed by a second third wheel which meshes with the fourth pinion, which is integral with a tourbillon cage. This second third wheel is integral with a star wheel, which periodically, in this case once per minute, releases a stop train meshed with the input third wheel set, which cooperates with the centre wheel, which therefore jumps once per minute. This mechanism minimises the transmission of shocks between the constant force device and the escapement.

EP Patent Application No. 1 528 443 A1 in the name of JOURNE, which discloses an independent constant force device, is also known. An energy storage spring tends to pivot a lever. A pinion of a first fourth wheel of the movement meshes with an intermediate wheel pivotally mounted on said lever. This intermediate wheel meshes with the pinion of a second fourth wheel, the arbour of which is secured to a tourbillon escapement. The lever carries a finger, which is arranged to cooperate with a ratchet toothing of a stop wheel which meshes with the first fourth wheel. When the finger is in mesh with a radial flank of the ratchet, the gear train is stopped and there is no transmission of force between the first fourth wheel and the intermediate wheel. During this stopped period, which lasts for one second, the spring torque is released and causes the lever to rotate until the finger is released from the ratchet. The second fourth wheel is controlled by the escapement, and only rotates when the said escapement is moved by the balance. The spring is wound by the movement of the lever in the opposite direction, said spring exerting a lower torque on the balance than that exerted by the barrel spring on the lever when the stop wheel is released. This device allows the winding/letting down cycle to be adapted by choosing the number of teeth in the stop wheel. The working of the device requires the presence of the energy storage spring.

In each case, the constant force device provides an advantage, which is to ensure a relatively constant drive torque for the escapement, but which necessarily involves a significant space requirement and high costs.

SUMMARY OF THE INVENTION

The invention proposes to provide a more economical alternative karussel with independent seconds, which uses the simplicity of star wheel and flirt devices, but reduces shocks and requires the fewest possible additional components within the smallest possible volume.

The invention concerns a mechanism for advancing, by periodic jumps, a cage pivoting about a cage axis, said cage carrying an escape wheel and an escape pinion in addition to a pallet lever cooperating with said escape wheel and with a sprung balance, said mechanism comprising:

- a motion transmitting gear train driven by an input drive means to pivot said cage and said escape pinion;
- a pivoting retaining means arranged to cooperate with said cage to authorise or to prevent the pivoting of said cage, depending on whether said retaining means is pivoting or stopped;
- a pivoting stopping means arranged to cooperate with said retaining means to authorise or prevent the pivoting of said retaining means, according to the angular pivoting position of said pivoting stopping means;
- said retaining means having a trajectory that interferes with that of said stopping means, characterized in that said retaining means, and said stopping means, are external to said cage, and further characterized in that said retaining means includes a flirt pinion carrying a flirt which is arranged to cooperate with said stopping means and whose trajectory interferes with said stopping means, said flirt pinion cooperating with a toothing comprised in said cage, via an inverter wheel set.

According to a feature of the invention, said motion transmitting gear train permanently meshes with said escape pinion to cause said pinion to pivot about an escape arbour carried by said cage, and tends to pivot said cage about said cage axis via said escape arbour.

According to a feature of the invention, under the action of said motion transmitting gear train, said cage permanently pushes said retaining means against said stopping means, to pivot said cage when said stopping means allows the pivoting of said retaining means, and to stop said cage when said stopping means locks said retaining means.

According to a feature of the invention, said stopping means includes a star wheel secured to a permanently driven star pinion, and said retaining means includes a flirt integral with a flirt pinion directly or indirectly meshing with said cage, the trajectory of said flirt interfering with that of said star wheel, in order to pivot said cage when said star wheel releases said flirt and otherwise stopping said cage.

According to another feature of the invention, said star pinion is permanently driven by a train driving the star wheel which is connected to said motion transmitting gear train, directly or via said escape pinion.

According to a particular feature of the invention, said retaining means and said stopping means are arranged to cause said cage to make one jump per second.

The invention more particularly concerns a jump mechanism for the cage of an independent seconds karussel.

This new embodiment is characterized by its great simplicity, the low number and low cost of additional components and by their great compactness.

The invention also concerns a karussel including a karussel cage and mechanism of this type.

The invention also concerns a timepiece including this type of mechanism or karussel.

BRIEF DESCRIPTION OF THE DRAWINGS

Other features and advantages of the invention will appear in more detail upon reading the following description, with reference to the indexed drawings, in which.

DETAILED DESCRIPTION OF PREFERRED EMBODIMENTS

Figure 1:
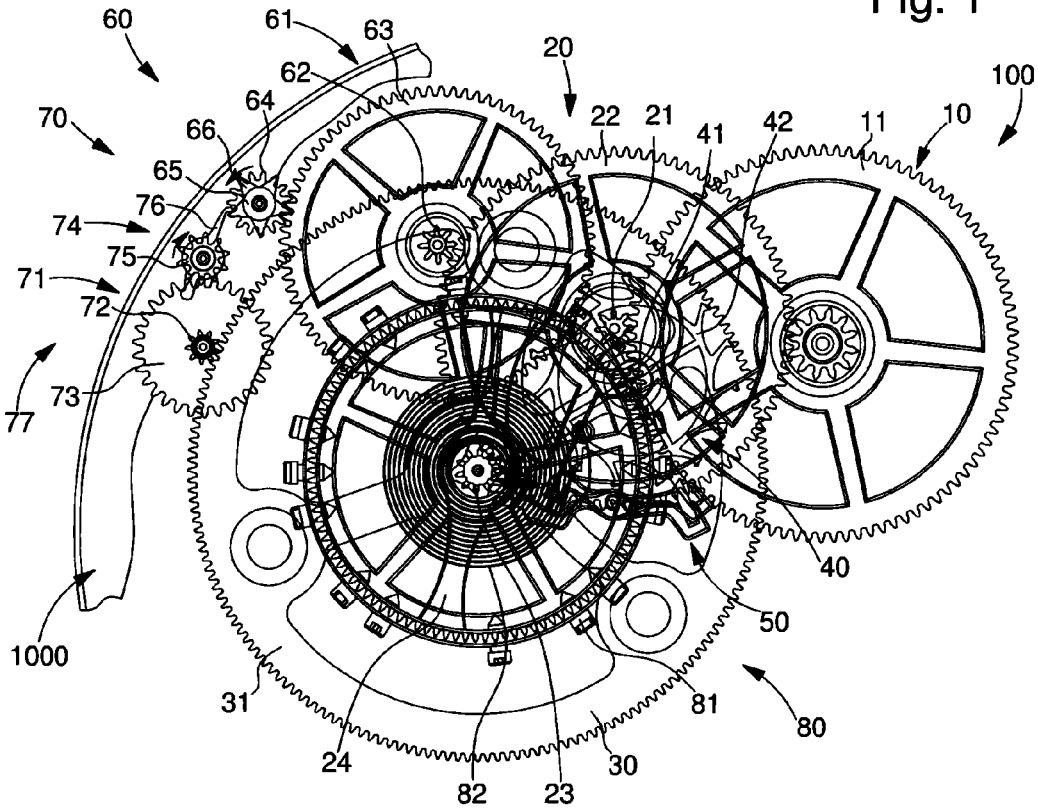
FIG. 1 shows a schematic plan view of a jumping mechanism according to the invention, in a preferred embodiment.

Advancing mechanism 100 according to the invention is a mechanism for advancing, by periodic jumps, a means of displaying a magnitude of time, particularly the seconds, comprising:

- an input drive means 10, pivotally moveable relative to a plate;
- a motion transmitting gear train 20 which is driven by said input drive means 10 and whose components are pivotally moveable relative to a plate;
- a karussel cage 30, pivotally moveable relative to a plate. This cage 30 pivots about a cage axis, and carries an escape mechanism 40 comprising an escape wheel 42 and an escape pinion 41 in addition to a pallet lever 50, which cooperates with escape wheel 42 and with a sprung balance 80. Preferably, but not necessarily, escape wheel 42 and escape pinion 41 are coaxial.

Motion transmitting gear train 20 is arranged to permanently pivot escape pinion 41 and cage 30 when the cage is free to rotate.

In particular, the jump forward is achieved in this cage 30. The principle of the invention is to subject the pivoting movement of the cage to a certain period, which is not necessarily determined by the oscillator frequency as is usually the case, but which is chosen at a particular rhythm, for example in the embodiment described below where the cage changes from second to second while marking the second.

To achieve this forward jump, mechanism 100 includes:

- a retaining means 70, which preferably pivots, arranged to cooperate with cage 30 to allow or prevent the pivoting movement of said cage, according to whether said means is pivoting or stopped;
- a stopping means 60, which preferably pivots, arranged to cooperate with retaining means 70 in order, depending on the position of stop means 60, to allow or prevent the movement of said retaining means 70, in particular the pivoting movement when said retaining means is a pivot means.

Retaining means 70 has a trajectory which interferes with that of stopping means 60.

According to the invention, the retaining means and the stopping means 60 are arranged outside cage 30, i.e. they are not carried by cage 30. Indeed, to avoid needlessly complicating the "on board" mechanism, and to prevent any interference in the inner volume of the cage, the invention proposes to provide a more economical alternative karussel with independent seconds, which uses the simplicity of star wheel and flirt devices, but reduces shocks and requires the fewest possible additional components in the smallest possible volume, said volume being preferably arranged outside the cage.

Motion transmitting gear train 20 permanently meshes with escape pinion 41 to pivot said pinion about an escape arbour carried by cage 30, and it tends to pivot cage 30 about the cage axis via the escape arbour.

Specifically according to the invention, under the action of motion transmitting gear train 20, cage 30 permanently pushes retaining means 70 against stopping means 60, to pivot cage 30 when stopping means 60 releases retaining means 70, in particular to allow the pivoting thereof, and to stop cage 30 when stopping means 60 locks said retaining means 70. Motion transmitting gear train 20 is the only drive member pushing retaining means 70 against stopping means 60, which advantageously avoids the requirement for any additional energy storage means using a spring or other element.

According to the invention, retaining means 70 includes a flirt pinion 75 carrying a flirt 76 arranged to cooperate with stopping means 60 and having a trajectory which interferes with said stopping means 60, said flirt pinion 75 cooperating with a toothing 31 comprised in cage 30, via an inverter wheel set 71.

Two alternative embodiments are illustrated in the Figures. The preferred embodiment is shown in FIG. 1. The numerical examples below relating to the number of teeth of the gear train components are a non-limiting embodiment example. Likewise, the mechanism according to the invention, which is described here for the jumping display of independent seconds, is applicable to the display of another independent magnitude (the minutes or other magnitude), the various pinions and wheels being calculated accordingly.

Input drive means 10 is arranged in a conventional manner to receive energy in the form of torque transmitted by energy storage means such as a barrel, weight or similar element. In a preferred embodiment seen in FIG. 1, this input drive means 10 is a centre wheel 11, which completes one revolution per hour and comprises N1 teeth, for example 96 teeth here. This centre wheel 11 pivots permanently, provided the energy storage means is able to deliver energy to the mechanism.

Motion transmitting gear train 20 is of very variable composition. Here it includes a third pinion 21 and a third wheel 22 respectively with N2 and N3 teeth, in the example 8 and 90 teeth. Third pinion 21 meshes with the centre wheel 11.

Third wheel 22 meshes with a star drive wheel set 61, on an intermediate star drive pinion 62 comprising N4 teeth coupled to an intermediate star drive wheel 63 comprising N5 teeth. Here, N4=8 and N5=80 teeth, so that the intermediate star drive wheel 63 drives a star pinion 64 with N6 teeth. Here N6=15 teeth so that star wheel 65 completes one revolution in (N1×N3×N5)/ (N2×N4×N15×60)=(96×90×809/(8×8×15×60)=5 seconds. This star pinion 64 has N15 teeth and carries a retaining star wheel 65 comprising NE blades 66. Here, N15=15 and NE=5 and a given point is achieved by a blade with a period of T=NE×(N1×N3×N5)/(N2×N4×N15×60×60)=1 second in this case. This retaining star wheel 65 thus permanently pivots under the action of input drive means 10 and motion transmitting gear train 20.

Further, third wheel 22, comprising N3 teeth (N3=90 here) meshes with a fourth pinion 23 comprising N8 teeth (N8=10 teeth here). This fourth pinion 23 is integral with a fourth wheel 24 comprising N9 teeth. This fourth wheel 24 meshes in a conventional manner with an escape pinion 41 comprising N10 teeth. In the present example, the fourth pinion 23 comprises N8=10 teeth, and the fourth wheel 24 comprises N9=105 teeth, whereas escape pinion 41 comprises N10=7 teeth and is connected to an escape wheel 42 which comprises N11=15 teeth and which is arranged to cooperate with a pivoting pallet lever 50 which cooperates with a sprung balance 80.

Cage 30 is preferably a karussel cage, as seen in the Figures, and it includes a toothing 31 with N7 teeth and pivots about a cage axis. This cage 30 has a point to which a first end of a balance spring 82 is fastened, the other end of which is fastened to a balance 81 which is pivotally moveable, preferably about said cage axis. In this latter case, cage 30 is therefore coaxially mounted to sprung balance 80 which is formed of balance 81 and balance spring 82.

Said cage 30 includes:

- escape mechanism 40 comprising an escape wheel 42 pivoting about an escape axis parallel to said cage axis, preferably off-centre in a preferred embodiment shown in the Figures;

a pallet lever 50 pivoting about a pallet lever axis parallel to said cage axis and arranged to cooperate with escape wheel 42, preferably off-centre in a preferred embodiment shown in the Figures;

It is clear that, under the action of input drive means 10, formed here by centre wheel 11, and of motion transmitting gear train 20, formed here by third pinion 21, third wheel 22, fourth pinion 23 and fourth wheel 24, the escape pinion 41 is permanently driven by fourth wheel 24. This fourth wheel 24 exerts a torque on said escape pinion which tends both to pivot escape pinion 41 on itself, in order to regulate the oscillation of sprung balance 80, by means of escape wheel 42 and pallet lever 50, and also to pivot the arbour of said escape pinion 41 about the pivot axis of the fourth wheel 24.

The pivot axis of fourth wheel 24 merges with the pivot axis of cage 30 which carries the pivot pin of escape pinion 41. The pivoting movement of fourth wheel 24 therefore always tends to pivot cage 30 in the same direction as that of fourth wheel 24, which is clockwise here. Consequently, if an obstacle prevents cage 30 from pivoting, only the pivoting movement of escape pinion 41 occurs, and the regulation of the oscillator is therefore never interrupted. If the obstacle is removed and cage 30 is allowed to pivot, cage 30 pivots in the same direction as fourth wheel 24 and escape wheel 41 also pivots about its axis in the same way as in the preceding case.

The preferably pivoting retaining means 70 is arranged to cooperate with cage 30 in order to allow or prevent the pivoting of cage 30, depending upon whether said means is moving or stopped. In this embodiment, retaining means 70 includes a retaining wheel set 77. This retaining wheel set 77 includes a wheel or pinion meshing with toothing 31 of cage 30.

The preferably pivoting stopping means 60 is arranged to cooperate with said retaining means 70 to authorise or prevent the pivoting of said retaining means 70, according to the angular pivoting position of said stopping means 60 (when it is able to pivot); Preferably, this stopping means 60 includes a retaining star wheel 65, integral with a star pinion 64, as described above, which is permanently pivoted and each tooth 66 of which is arranged to cooperate with a flirt 76 belonging to retaining means 70 and periodically to stop and release said flirt 76 according to the angular position of retaining star wheel 65. Star pinion 64 may preferably be driven, as seen in the present example embodiment, by transmitting train 20, either directly or via escape pinion 41.

Pivoting retaining means 70 is therefore formed, in the example shown in the Figures, by a flirt wheel set 74 comprising a flirt pinion 75 with N14 teeth, and which carries at least one flirt 76, pivotally mobile about the axis of flirt wheel set 74 and arranged to cooperate with a retaining star wheel 65. The trajectory of flirt 76 interferes with that of star wheel 65, in order to pivot cage 30 when star wheel 65 releases flirt 76 and otherwise to lock said cage. Flirt pinion 75 meshes directly or indirectly with toothing 31 of cage 30.

In certain positions, such as that shown in FIG. 1, flirt 76 is held under tension, in abutment on a blade 66 of retaining star wheel 65 until said star wheel reaches an angular position that allows the release of flirt 76, or of a flirt arm if flirt 76 comprises multiple arms, a double arm or star for example. Preferably, flirt 76 has multiple arms, or is star-shaped which allows great flexibility of use, and easily enables the desired jump value to be obtained for the cage. With the design of the invention it is thus easy to select the desired magnitude to be displayed with a jump, whether it is for example, a fifth of a second, a tenth of a second, a minute or other magnitude, simply by carefully calculating the gear train and specifically by the selection of the number of arms of flirt 76. The invention also allows a spin-off design, with a cage revolution whose duration is not a minute, for example which has a duration of thirty seconds.

Preferably, as seen in FIG. 1, retaining wheel set 77 includes an inverter wheel set 71 which is meshed, on the one hand, with the toothing 31 and with flirt wheel set 74, on the other hand. Said inverter wheel set 71 comprises an inverter pinion 72 meshing with wheel 31 and an inverter wheel 73 integral with said inverter pinion 72. Flirt pinion 75 meshes with inverter wheel 73. Flirt pinion 75 then cooperates with toothing 31 of cage 30 via inverter wheel set 71. The use of this inverter wheel set is advantageous, since it provides a particular advantage which concerns shock absorption. Further, in an advantageous embodiment, this inverter wheel set is made in the form of an elastic pinion, for example with an S-shaped arm or flexible elastic arms, or with a radiating structure comprising thin elastic arms, or a pinion comprising slots, or an annular part made of elastic material or rubber or similar. Naturally, the inverter wheel set can also be a pinion train with a non-integer number of pinions. Preferably, inverter wheel set 71 includes at least one such elastic pinion.

In the example of FIG. 1, when flirt 76 is released by tooth 66 of star wheel 65, which holds it stopped, i.e. each second in this particular case, it allows the pivoting movement of flirt wheel set 74, here through a complete rotation, until flirt 76 abuts again on another blade of retaining star wheel 65. If flirt 76 has multiple arms, the pivoting amplitude is reduced accordingly, for example to a half revolution if flirt 76 comprises two opposite arms, as in the example of FIG. 3.

In the present application, which is for the display of an independent magnitude, particularly independent seconds, in the motion of cage 30, it is preferable for flirt wheel set 74 to complete one revolution to allow the use, in a preferred embodiment seen in FIG. 1, of an inverter wheel set 72 adapted to the desired direction of display, and some shock absorption, owing to the insertion of a demultiplication gear train. In the present example, flirt pinion 75 comprises N14=10 teeth, and cooperates with an inverter wheel 73 with N13=30 teeth connected to an inverter pinion 72 with N12=9 teeth. This inverter pinion 72 directly meshes with cage 30 and allows 3 teeth of toothing 31 of cage 30 to pass for each revolution of flirt wheel set 74. Cage 30 has N7=180 teeth and therefore makes 60 jumps per minute. Inverter wheel set 72 causes flirt wheel set 74 to pivot in the same direction as cage 30.

This design is advantageous, since it is easy to select the magnitude to be displayed by one jump, whether this is, for example, a fifth of a second, a tenth of a second, a minute or other magnitude, simply by adequately calculating the gear train. It also allows a spin off design with a cage revolution whose duration is not a minute, for example with a duration of thirty seconds.

The number of revolutions per second ωE completed by star wheel 65 is the result of the calculation relating to motion transmitting gear train 20 and star wheel drive 61:

$$\omega E=\Omega\times(N1\times N3\times N5)/(N2\times N4\times N15\times 60\times 60),$$ Ω being the angular velocity in revolutions per hour of centre wheel 11, Ω=1 in this particular case;

in the example shown: ωE=1×(96×90×80)/(8×8×15×60)=0.20 revolutions per second. Star wheel 65 has here NE=5 blades, a given point is achieved by a blade 66 of star wheel 65 with a period T:

$$T=\Omega E\times NE=(N1\times N3\times N5)/(N2\times N4\times N15\times 60)\times NE=0.20\times 5=1 \text{ second.}$$

Figure 3:
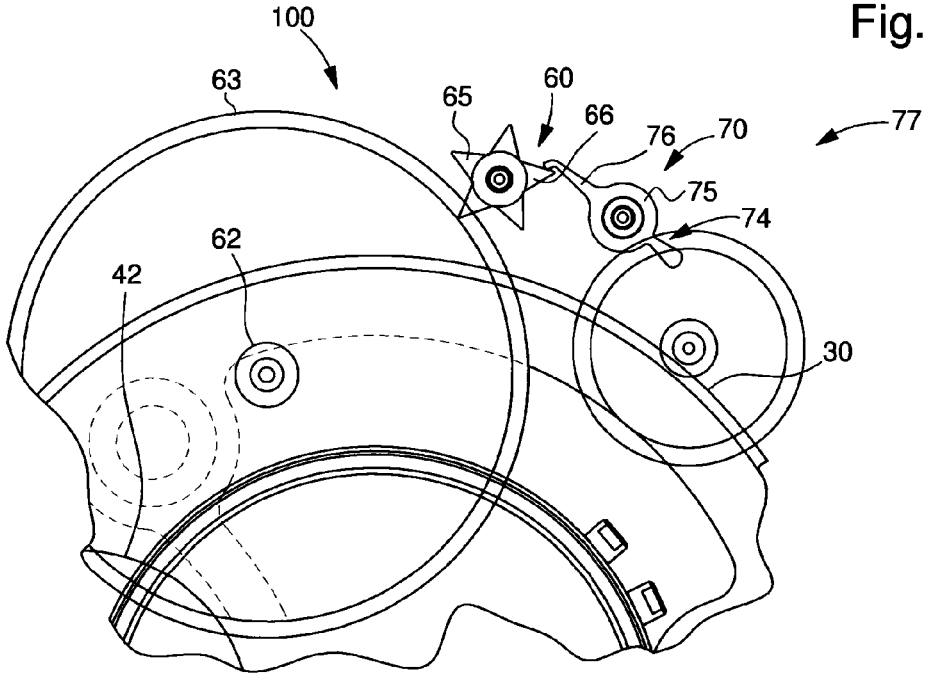
FIG. 3 shows a detail of FIG. 2.

The number of teeth of toothing 31 released at each flirt revolution, for a flirt with a single arm, is equal here to:

N14×N12/N13=10×9/30=3. The gear train examples shown here are for an oscillator frequency of 3 Hz, with a cage 30 provided with a toothing 31 having 180 teeth, and rotating in one minute. Naturally, other gearings can be defined to have a toothing 31 of 60 or 120 teeth, or even to modify the pivoting velocity of the cage. Likewise, the number of arms of flirt 76 may be modified. The calculation above is given for the example of a single arm, and therefore one complete flirt revolution between two consecutive teeth of star wheel 65. Thus a flirt with n arms, for example n=2 as seen in FIG. 3, would only allow past a corresponding portion 1/n per revolution of flirt pinion 75 and thus (N14×N12)/(n×N13) teeth of toothing 31. In the present example of FIG. 1, each revolution of flirt wheel set 74 thus allows N14×N12/N13=3 teeth of toothing 31 of cage 30 to pass and said cage therefore performs N7/(N14×N12/N13)=60 jumps per revolution.

Cage 30 pivots at a velocity of: ΩC=(N14×N12/N13)×60/(T×N7) revolutions per minute in this example of single arm flirt 76. It therefore completes one revolution per minute here.

Figure 2:
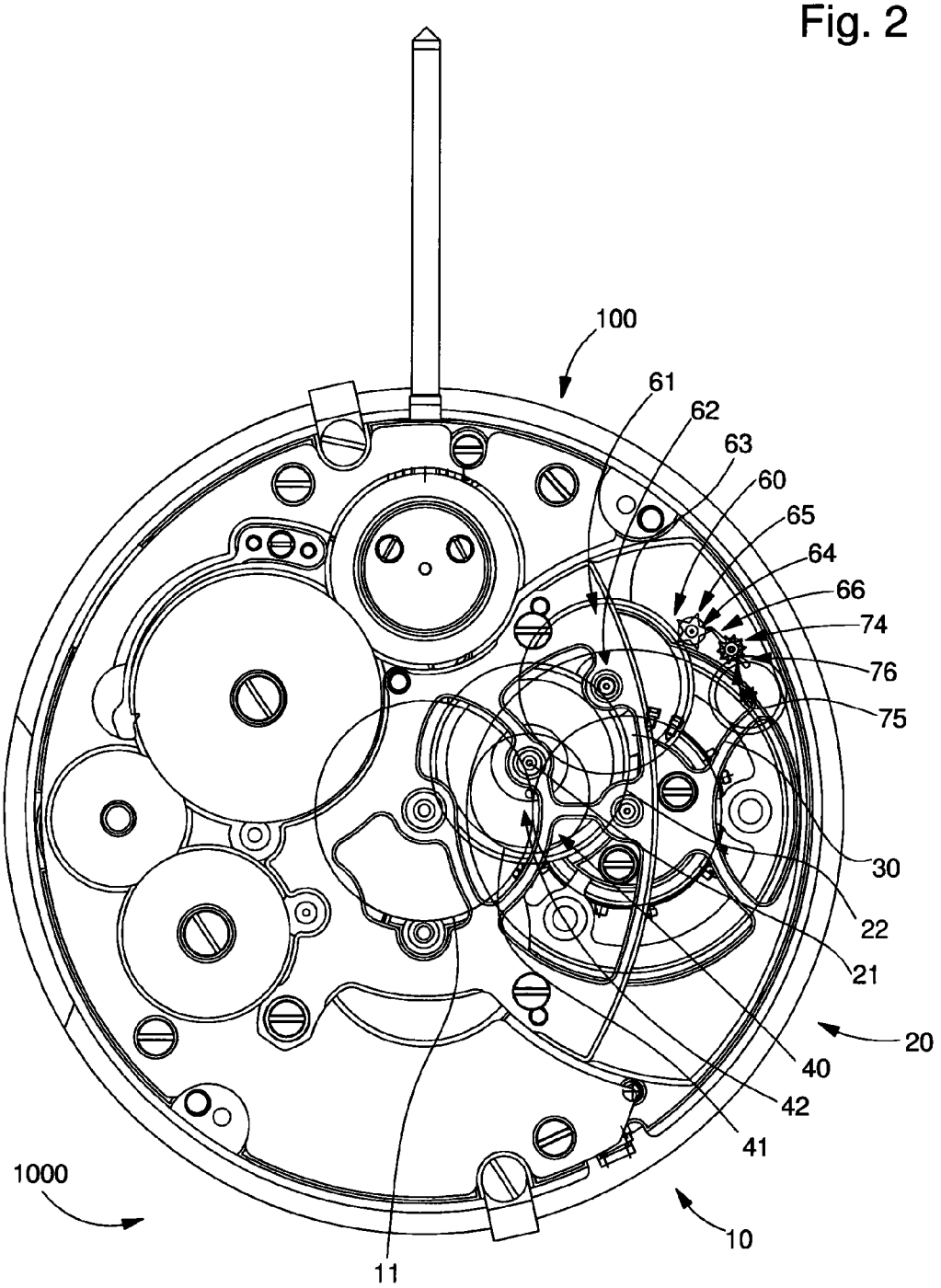
FIG. 2 shows a schematic, partial, plan view of the timepiece including a jumping mechanism according to a second embodiment.

FIGS. 2 and 3 illustrate a second embodiment, without an inverter pinion, and with a flirt comprising two flirt arms. Flirt wheel set 74 then makes one half revolution before a flirt arm returns to abutment on a blade 66 of star wheel 65. FIG. 3 illustrates the very small dimension of star wheel 65 and of flirt wheel set 74 compared to the gear train and to cage 30.

In this example of FIG. 3, transmitting train 20 is identical to that of FIG. 1, as is escape mechanism 40. Flirt 76 comprises n=2 arms. However, this variant does not have an inverter wheel set 71, and flirt wheel set 74 directly meshes with toothing 31 of cage 30. Flirt pinion 75 has N14=6 teeth here. Each passage of a star wheel tooth 66 enables flirt pinion 75 to make 1/n=1/2 of a revolution, which releases N14×1/n=6×1/2=3 teeth of toothing 61. Cage 30 thus performs N7/(N14×1/n)=180/3=60 jumps per revolution. The period T is identical to that of FIG. 1. Cage 30 pivots at a velocity ΩC=(N14×1/n)×60/(T×N7)=3×60/(1×180)=1 revolution per minute.

Mechanism 100 according to the invention is a mechanism without any energy storage spring and is formed, in particular, of rigid elements, which is advantageous, particularly in terms of maintenance. There is no energy storage problem here requiring the presence of elastic elements in mechanism 100. The presence of any elastic elements, or partially elastic elements, may be useful for damping purposes, such as the aforementioned inverter pinion, but any elastic function of such components is strictly limited to this damping function, with a much reduced deformation travel, of around a tenth of a millimetre or less. Mechanism 100 is advantageously formed of rigid or very slightly resilient elements. The mechanism is very simple and inexpensive yet very reliable.

The invention more particularly concerns a mechanism 100 for advancing the cage of an independent seconds karussel by jumps.

The invention also concerns a karussel comprising a karussel cage 10 and a mechanism 100 of this type.

The invention also concerns a timepiece comprising this type of mechanism 100 or karussel.

The invention claimed is:

1. A mechanism for advancing, by periodic jumps, a cage pivoting about a cage axis, said cage carrying an escape wheel and an escape pinion in addition to a pallet lever cooperating with said escape wheel and with a sprung balance, said mechanism comprising:

a motion transmitting gear train driven by an input drive means to pivot said cage and said escape pinion;

a pivoting retaining means arranged to cooperate with said cage to authorize or to prevent the pivoting of said cage, depending on whether said retaining means is pivoting or stopped;

a pivoting stopping means arranged to cooperate with said retaining means to allow or prevent the pivoting of said retaining means, according to an angular pivoting position of said stopping means, said retaining means having a trajectory that interferes with that of said stopping means, wherein said retaining means and said stopping means are external to said cage, and further wherein said retaining means includes a flirt pinion carrying a flirt which is arranged to cooperate with said stopping means and whose trajectory interferes with said stopping means, said flirt pinion directly cooperating with an inverter wheel of an inverter set, said inverter set including an inverter pinion which is integral with said inverter wheel, and said inverter pinion directly cooperating with a peripheral toothing provided on said cage.

2. The mechanism according to claim 1, wherein said motion transmitting gear train permanently meshes with said escape pinion to cause said escape pinion to pivot about an escape arbour carried by said cage, and can pivot said cage about said cage axis via said escape arbour.

3. The mechanism according to claim 1, wherein, under action of said motion transmitting gear train, said cage permanently pushes said retaining means against said stopping means, to pivot said cage when said stopping means allows the pivoting of said retaining means, and to stop said cage when said stopping means locks said retaining means, said motion transmitting gear train being the only drive member pushing said retaining means against said stopping means.

4. The mechanism according to claim 1, wherein said stopping means includes a star wheel secured to a permanently driven star pinion meshing via said integral motion transmitting gear train with said escape pinion, and said retaining means includes a flirt integral with a flirt pinion directly or indirectly meshing with said cage, the trajectory of said flirt interfering with that of said star wheel, to pivot said cage when said star wheel releases said flirt and otherwise stopping said cage.

5. The mechanism according to claim 4, wherein said star pinion is permanently driven by a star wheel drive train which is connected to said motion transmitting gear train, directly or via said escape pinion, said integral motion transmitting gear train including a third pinion and a third wheel, said third pinion meshing with a centre wheel, said third wheel meshing with a star drive wheel set, on an intermediate star drive pinion comprising coupled to an intermediate star drive wheel, said star pinion carrying a retaining star wheel which permanently pivots under the action of said input drive means and said motion transmitting gear train, and said third wheel meshing with a fourth pinion which is integral with a fourth wheel, said fourth wheel meshing in with said escape pinion, and wherein the pivot axis of said fourth wheel merges with the pivot axis of said cage which carries the pivot pin of said escape pinion, the pivoting movement of said fourth wheel therefore always tending to pivot said cage in the same direction as that of said fourth wheel, in order to allow only the pivoting movement of said escape pinion if an obstacle prevents said cage from pivoting and to secure the regulation of the oscillator.

6. The mechanism according to claim 1, wherein said retaining means and said stopping means are arranged to cause said cage to perform one jump per second.

7. The mechanism according to claim 1, wherein said cage is coaxial to said sprung balance.

8. The mechanism according to claim 1, wherein said escape wheel and said escape pinion are coaxial.

9. The mechanism according to claim 1, wherein said escape wheel and said escape pinion are off-center relative to said cage.

10. The mechanism according to claim 1, wherein said flirt is a flirt with multiple arms or a star-shaped flirt.

11. The mechanism according to claim 1, wherein said inverter wheel set includes at least one elastic pinion for shock absorption.

12. The mechanism according to claim 1, formed of rigid elements.

13. The mechanism according to claim 1, wherein said input drive means includes a center wheel, which has an angular velocity 106 of revolutions per hour and comprises N1 teeth, and wherein said motion transmitting gear train comprises a third pinion and a third wheel, respectively with N2 teeth and N3 teeth, said third pinion meshing with said center wheel, said third wheel meshing with an intermediate star drive pinion comprising N4 teeth coupled to an intermediate star drive wheel comprising N5 teeth, so that said intermediate star drive wheel drives a star pinion with N15 teeth, said star pinion carrying a retaining star wheel comprising NE blades, a given point being therefore reached by a blade of the star wheel with a period T=106 ×NE ×(N1×N3×N5)/(N2×N4×N15×60×60) seconds, and said third wheel also meshing with a fourth pinion, comprising N8 teeth, which is integral with a fourth wheel comprising N9 teeth, which meshes with said escape pinion comprising N10 teeth, which is connected to said escape wheel which comprises N11 teeth and which is arranged to cooperate with said pivoting pallet lever which cooperates with said balance, a flirt pinion comprising N14 teeth, cooperating with an inverter wheel with N13 teeth connected to an inverter pinion with N12 teeth, which, for each revolution of said flirt pinion carrying a flirt with a single arm, allows N14×N12/N13 teeth to pass of a toothing of the cage which comprises N7 teeth, said cage therefore performing N7/(N14×N12/N13) jumps per revolution and pivoting at velocity: 106 C=(N14×N12/N13)×60/(T×N7) revolutions per minute.

14. The mechanism according to claim 13, wherein 106 =1, N1=96, N2=8, N3=90, N4=8, N5=80, N15=5, NE=5, N8=10, N9=105, N10=7, N11=15, N14=10, N13=30, N12=9, N7=180, N15=5, T=1×5×(96×90×80)/(8×8×15×60×60)=1 second, N14×N12/N3=10×9/30=3 teeth, for each revolution of said flirt pinion carrying a single arm flirt, said mechanism allowing N14×N12/N13=10×9/3=3 teeth of said toothing to pass, said cage then performing N7/(N14×N12/N13)=60 jumps per revolution and pivoting at velocity: 106 C=(N14×N12/N13)×60/(T×N7)=1 revolution per minute, the oscillator frequency being 3 Hz.

15. A karussel including a karussel cage and a mechanism according to claim 1.

16. A timepiece including at least one mechanism according to claim 1.

17. A timepiece including at least one karussel according to claim 15.

* * * * *